US011280098B2

(12) United States Patent
Roberts

(10) Patent No.: US 11,280,098 B2
(45) Date of Patent: Mar. 22, 2022

(54) METHOD FOR CREATING A WOOD PLATFORM ON TOP OF SUPPORT BRACKETS

(71) Applicant: Eric S. Roberts, Genoa City, WI (US)

(72) Inventor: Eric S. Roberts, Genoa City, WI (US)

( * ) Notice: Subject to any disclaimer, the term of this patent is extended or adjusted under 35 U.S.C. 154(b) by 0 days.

(21) Appl. No.: 17/019,240

(22) Filed: Sep. 12, 2020

(65) Prior Publication Data

US 2020/0407985 A1 Dec. 31, 2020

Related U.S. Application Data

(63) Continuation-in-part of application No. 16/295,437, filed on Mar. 7, 2019, now Pat. No. 10,774,484.

(60) Provisional application No. 62/946,812, filed on Dec. 11, 2019, provisional application No. 62/794,790, filed on Jan. 21, 2019, provisional application No. 62/641,944, filed on Mar. 12, 2018.

(51) Int. Cl.

| | |
|---|---|
| ***E04G 13/00*** | (2006.01) |
| ***E04G 13/04*** | (2006.01) |
| ***E04B 1/35*** | (2006.01) |

(52) U.S. Cl.

CPC ..... *E04G 13/04* (2013.01); *E04B 1/35* (2013.01)

(58) Field of Classification Search

CPC ..... E04G 13/04; E04B 1/35
USPC ..... 14/78; 248/240.4, 242; 182/82
See application file for complete search history.

(56) References Cited

U.S. PATENT DOCUMENTS

| | | | | |
|---|---|---|---|---|
| 4,660,800 | A * | 4/1987 | Horstketter | E01D 21/00 249/24 |
| 7,032,268 | B2 * | 4/2006 | Jackson | E01D 21/00 14/78 |
| 7,159,262 | B2 * | 1/2007 | Jackson | E01D 21/00 14/77.1 |
| 8,529,157 | B2 * | 9/2013 | McKay | E02B 3/068 405/220 |
| 9,072,380 | B2 * | 7/2015 | Durgin | A47B 96/06 |
| 10,710,032 | B1 * | 7/2020 | List | C02F 3/205 |
| 10,774,484 | B2 * | 9/2020 | Roberts | E04G 17/00 |
| 2010/0243857 | A1 * | 9/2010 | Grimaldo | E04G 17/18 249/19 |

* cited by examiner

*Primary Examiner* — Raymond W Addie
(74) *Attorney, Agent, or Firm* — James Earl Lowe, Jr.

(57) ABSTRACT

A device for assisting to secure a bridge support bracket to a beam, the device comprising: a support frame, a hook to secure the support frame to the beam, a clamp to grasp and hold the bracket, and a pivot axle to pivotally connect the clamp to the support frame. When attaching at least two spaced apart such devices to the beam, then clamping a support bracket in each of the at least two spaced apart devices, both support brackets can be pivoted to a position where wood boards attached to the top of the support brackets are held in a not horizontal position. By then placing a wood stud in a position where it spans the two support brackets and attaching the wood stud to the respective bracket wood boards, a workman can then further pivot the support brackets to where the wood boards extend horizontally away from the beam.

1 Claim, 18 Drawing Sheets

METHOD FOR CREATING A WOOD PLATFORM ON TOP OF SUPPORT BRACKETS

CROSS-REFERENCE TO RELATED APPLICATIONS

This application claims the benefit of and priority to prior Application No. 62/641,944 filed Mar. 12, 2018, to Application No. 62/794,790 filed Jan. 21, 2019 and to Application No. 62/946,812 filed Dec. 11, 2019. This application is a Continuation-In-Part of application Ser. No. 16/295,437 filed Mar. 7, 2019.

BACKGROUND

This application is directed to bridge building, and, more particularly, to the use of bridge overhang support brackets used in bridge construction.

As illustrated in FIG. 1, modern-day bridges use steel or concrete I-beams 10 to support bridge loads. After placement of the I-beams, concrete roadways 14 are formed on top of the I-beams. Further, a portion 18 of the concrete roadway extends over the outside edges of the I-beam. When constructing the bridge, concrete forms 22 and the concrete 18 are supported by bridge overhang support brackets 30 secured to the I-beam 10. Each support bracket 30 includes a horizontal component 32, a vertical component 34, and an angled component 36 attached at one end to an end of the horizontal component, and another end attached to an end of the vertical component. As shown in FIG. 2, this process begins with the placement of a hanger 50 on the top of the I-beam 10. The hanger 50 is secured to the I-beam 10 in a conventional fashion, such as by attaching the rear of the hanger to the back side of the I-beam 10, as shown in FIG. 2, and a hanger end clip 52 is positioned just at the edge of the I-beam where the support bracket 30 is to be positioned.

The next step in this process is to support the bridge overhang support bracket 30 on the side of the I-beam 10 so a coil rod 54 can be inserted through an opening (not shown) in the hangar clip 52, and also inserted into a support bracket bolt holder 56 in the support bracket 30. After being inserted through openings in the hanger clip 52 and the bolt holder 56, the coil rod 54 is then secured in place by coil nuts 58 on the ends of the coil rod 54.

Placing each support bracket 30 in a position to receive the coil rod 54 is a challenge in modern day bridge making. Most often, workers beneath the new bridge must be lifted up with the support bracket to bridge level using a bucket truck or similar device. This requires for all traffic currently under the bridge to be diverted away from the bridge. Since many bridges are being made over active roadways, this requires highway lanes to be closed. This is an expensive and inconvenient situation. Further, supporting the bracket on the side of the I-beam usually requires at least two workers working together, with one on the side of the I-beam and one on top of the I-beam. This is strenuous and dangerous work. Further, this process when performed over water requires the need for watercraft to support the mechanism used to raise the support bracket to bridge level. Often times, the bridge is too high for help raising the support brackets from down below the bridge.

SUMMARY

Disclosed is a device for assisting to secure a bridge support bracket to a beam, the device comprising a support frame, a hook to secure the support frame to the beam, a clamp to grasp and hold the bracket, and a pivot axle to pivotally connect the clamp to the support frame. When attaching at least two spaced apart such devices to the beam, then clamping a support bracket in each of the at least two spaced apart devices, both support brackets can be pivoted to a position where wood boards attached to the top of the support brackets are held in a not horizontal position. By then placing a wood stud in a position where it spans the two support brackets and attaching the wood stud to the respective bracket wood boards, a workman can then further pivot the support brackets to where the wood boards extend horizontally away from the beam.

DRAWINGS

Figure 1:
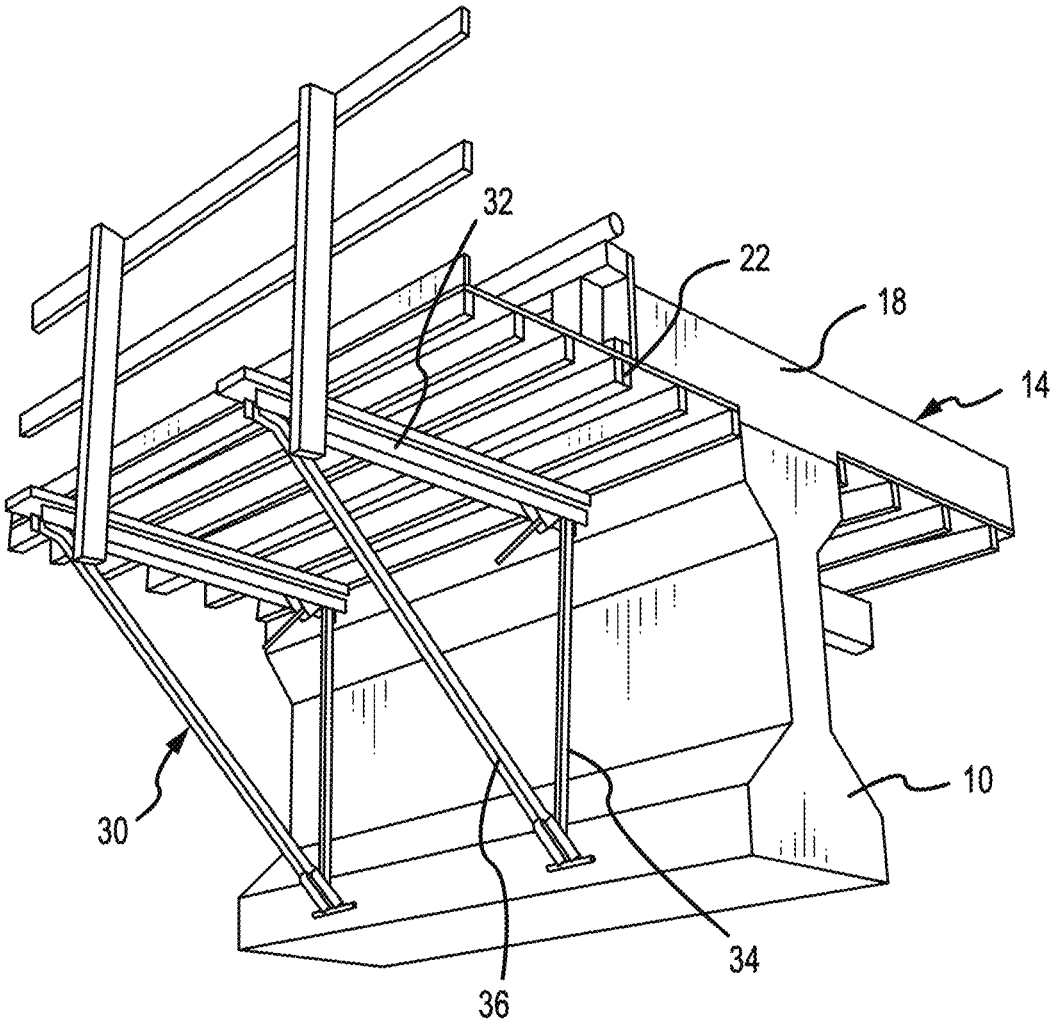
PRIOR ART FIG.1
FIG. 1 is a side perspective view illustrating bridge construction. An I-beam is show, with an attached bridge support bracket, and forming for the concrete bridge.
Figure 2:
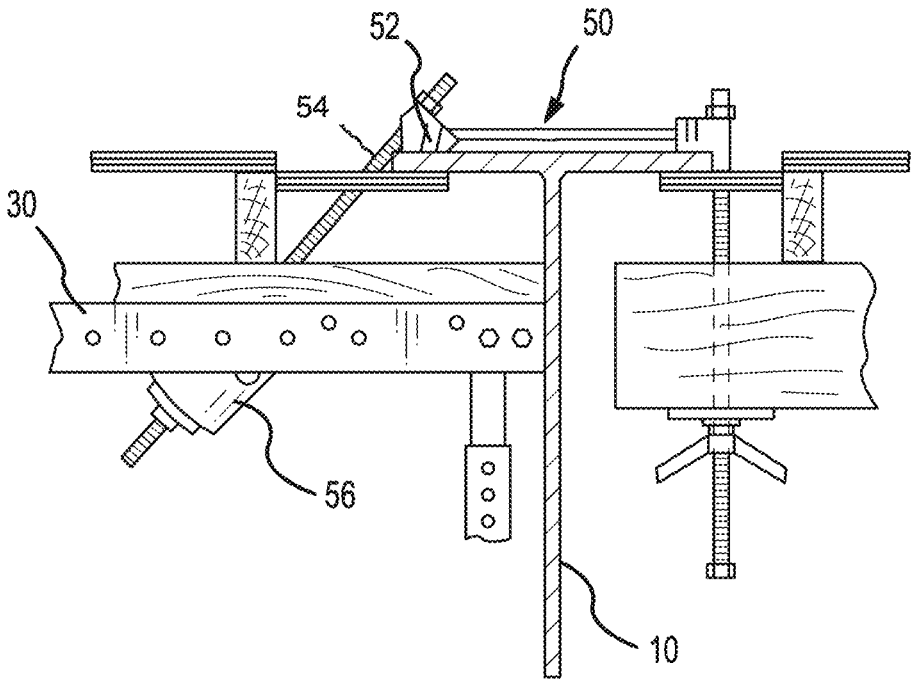
PRIOR ART FIG.2
FIG. 2 is a side view of a portion of an I-beam, a hanger, and a coil rod passing through a hanger end clip and a bracket bolt holder. A portion of a vertical component of the bridge support bracket is shown attached to a bridge support bracket horizontal component.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience in reference to the drawings and are not to be construed as limiting terms.

DESCRIPTION OF PREFERRED EMBODIMENTS

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 3:
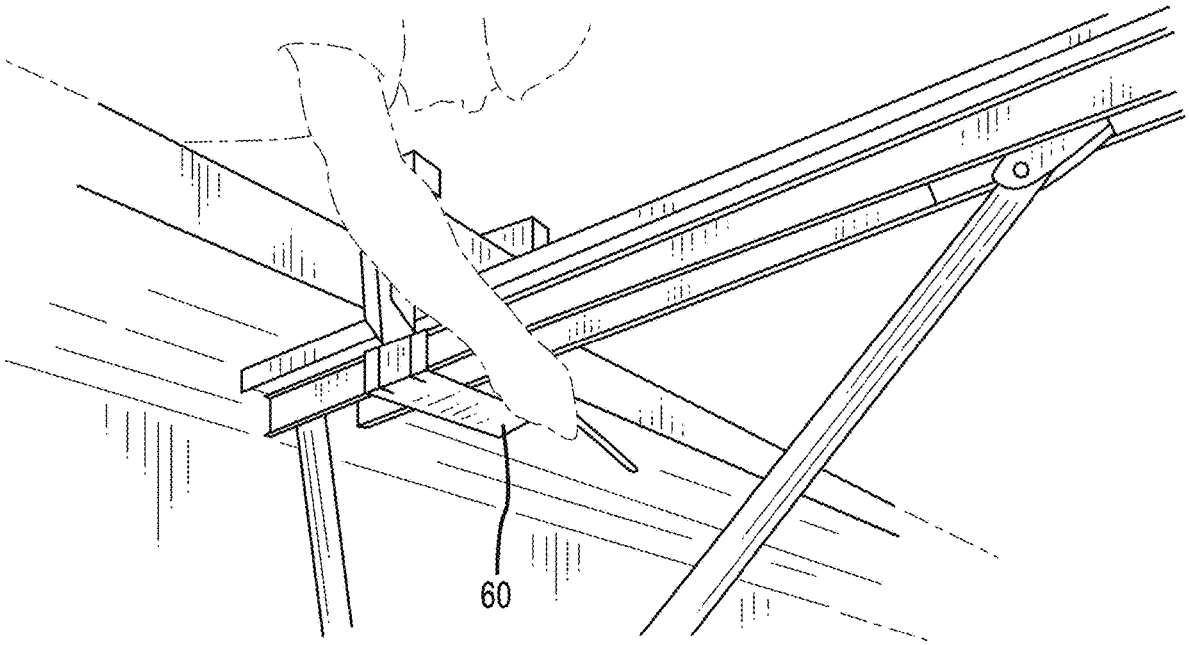
FIG. 3 is a side perspective view showing a construction worker attaching a bridge support bracket to a concrete I beam.
Figure 4:
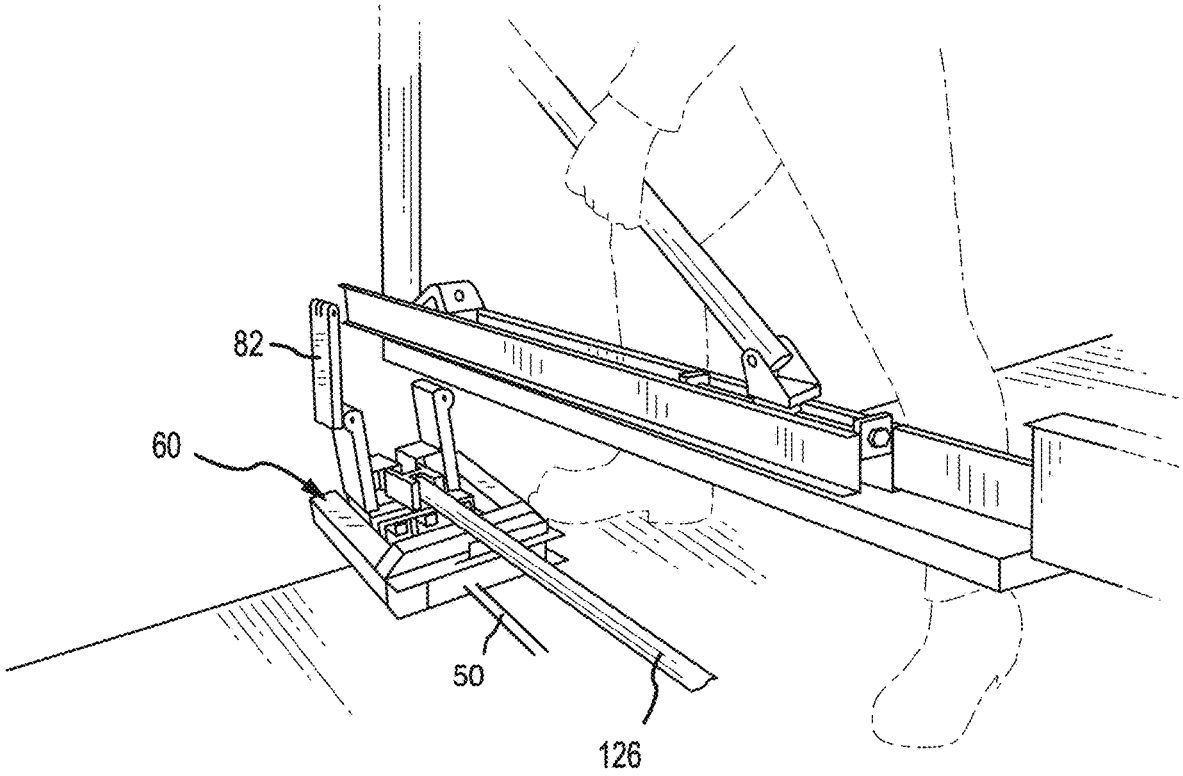
FIG. 4 is a rear perspective view of a bridge support bracket placement device attached to a concrete I beam, with a bracket clamp open and about to receive an end of the bridge support bracket.
Figure 5:
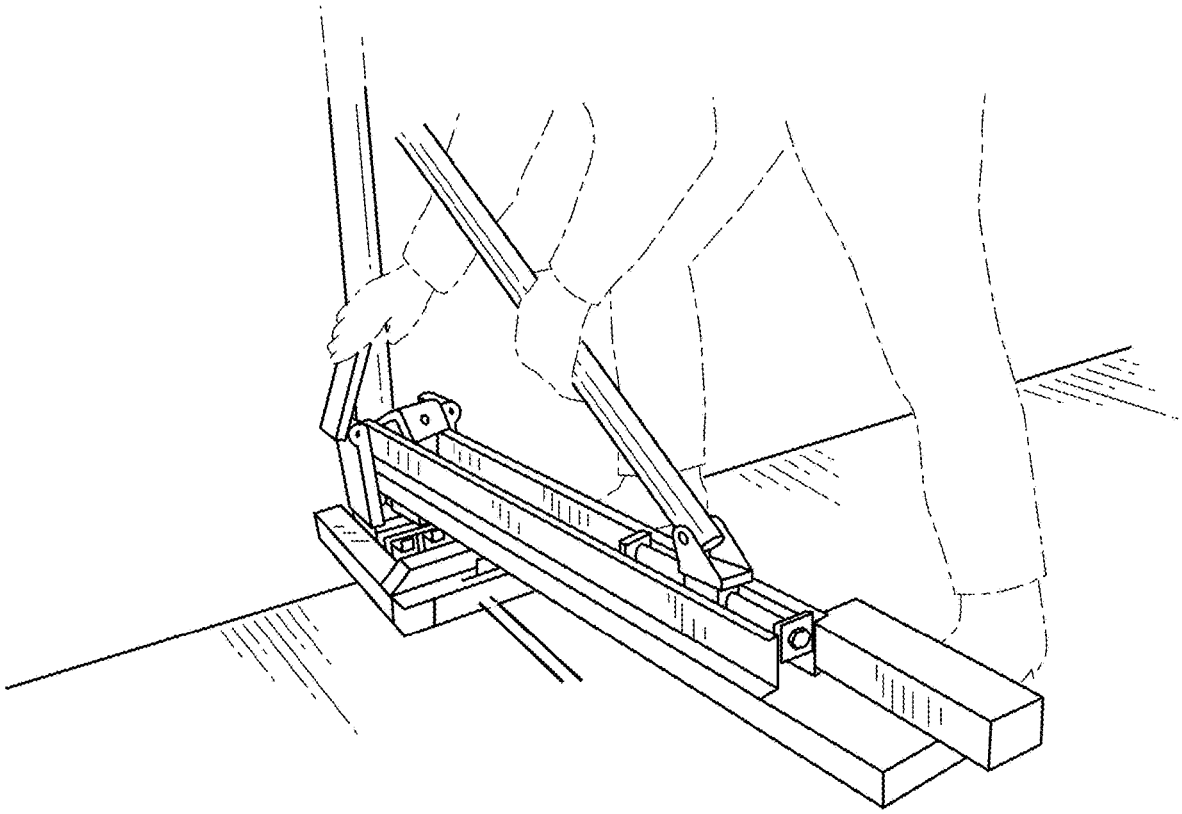
FIG. 5 is a rear perspective view similar to FIG. 4, only with the end of the support bracket now received within the clamp.

Illustrated in FIGS. 3 to 17 is a method of and a metal device 60 for securing a bridge support bracket 30 to an I-beam 10. With the disclosed device 60, a bridge overhang support bracket 30 can be placed in position by one individual. Once in place, the individual can secure the coil rod 54 to the support bracket 30 and to the hanger clip 52, as illustrated in FIG. 3. As shown in FIG. 4, the bridge support bracket placement device 60 is secured to the steel or concrete I-beam. In the illustrated embodiment, the device 60 is attached to the hanger 50 already secured to the I-beam 10, as shown in FIG. 10. In other embodiments (not shown), the back of the device 60 can be clamped to the I-beam 10 on the side opposite the support bracket 30, by having the device have extensions which hook over the backside of the I-beam. As shown in FIG. 10, the support bracket placement device 60 includes a device support frame 64, securing means 66 to secure the support frame to the beam, holding means in the form of a clamp 68 to grasp and hold the bracket 30, and pivot means 70 pivotally connecting the clamp 68 to the support frame 64. The pivot means includes spacing means 74 (see FIG. 13) for varying the spacing of the clamp 68 relative to the support frame 64 in both a horizontal direction and a vertical direction and controlling means 76 for controlling the pivoting of the clamp 68 relative to the support frame 64.

Figure 12:
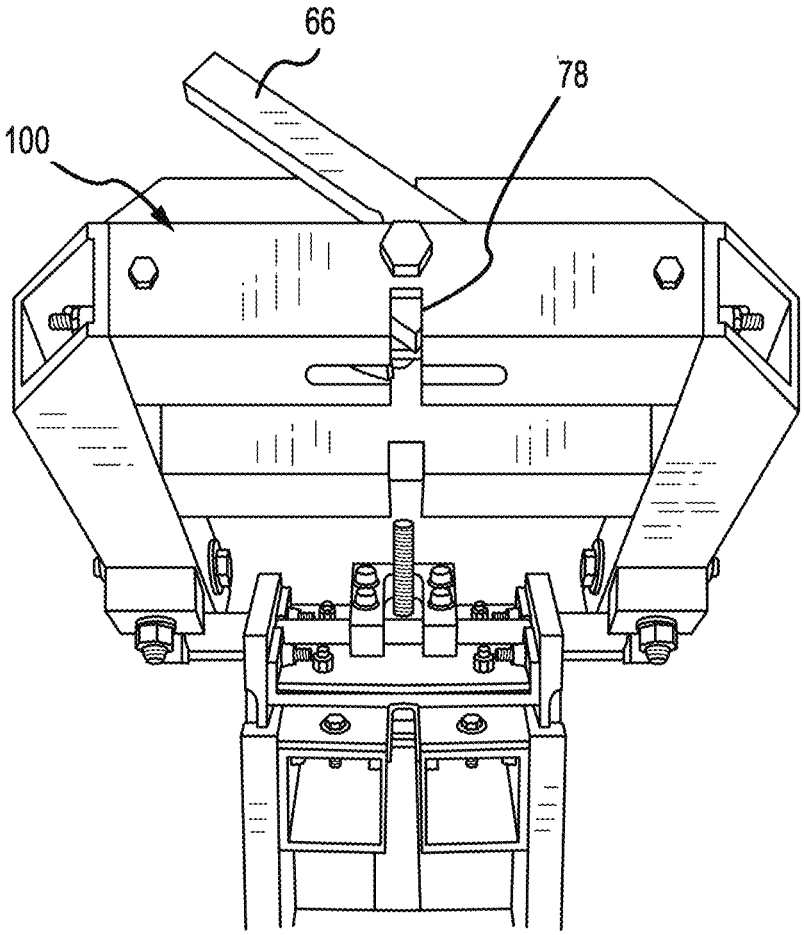
FIG. 12 is a bottom rear first end perspective view of the bridge support bracket placement device shown in FIG. 10, showing a hanger clamp in an open position.

More particularly, the securing means 66 is adapted to secure the device 60 to the hanger 50 attached to the top of an I-beam 10. The securing means in the disclosed embodiment is in the form of a hook 66 (see FIG. 12) mounted for rotation in a hanger slot 78 in the rear of the device support frame 64. The hook 66 is rotatable between a first position, where the hanger slot 78 in the bottom rear of the device support frame 64 is open as shown in FIG. 12 to receive the hanger 50, and a second position where the hook 66 holds the hanger 50 in the hanger slot 78.

Figure 6:
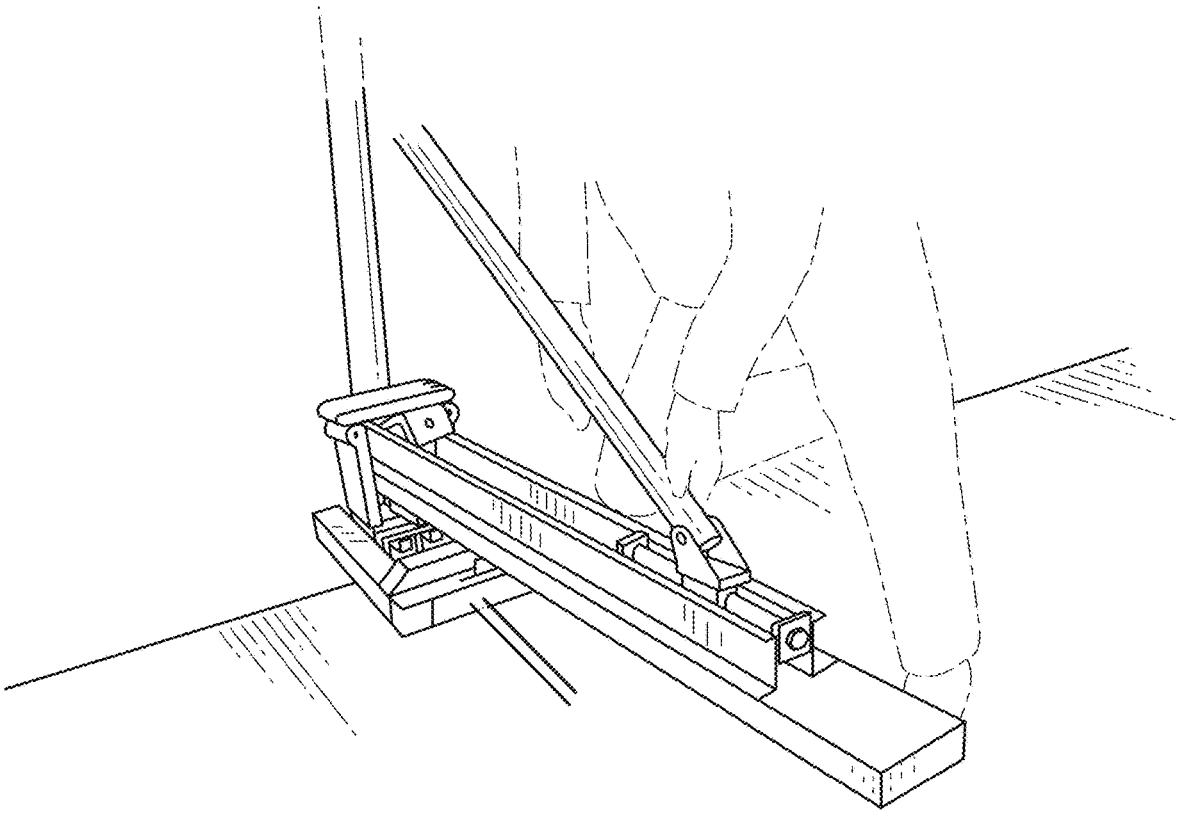
FIG. 6 is a rear perspective view similar to FIG. 4, only with the end of the support bracket now secured within the clamp.
Figure 7:
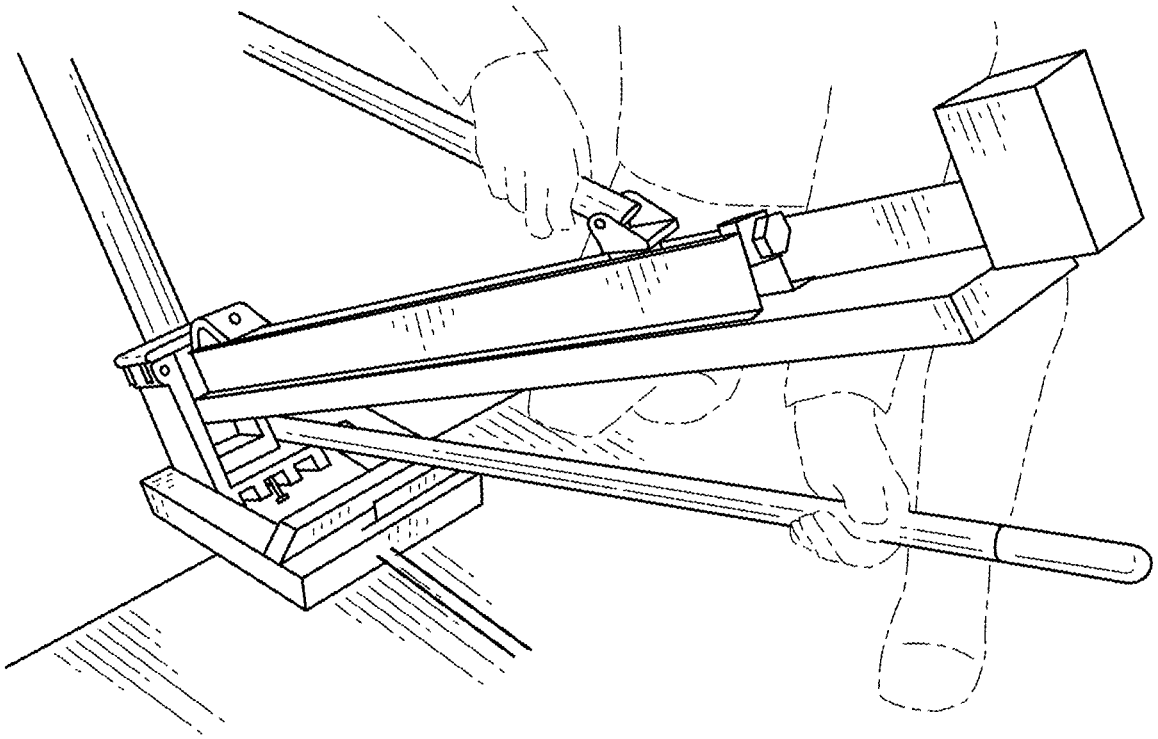
FIG. 7 is a rear perspective view similar to FIG. 4, only now with the clamp beginning to pivot to place the support bracket in its final position.
Figure 13:
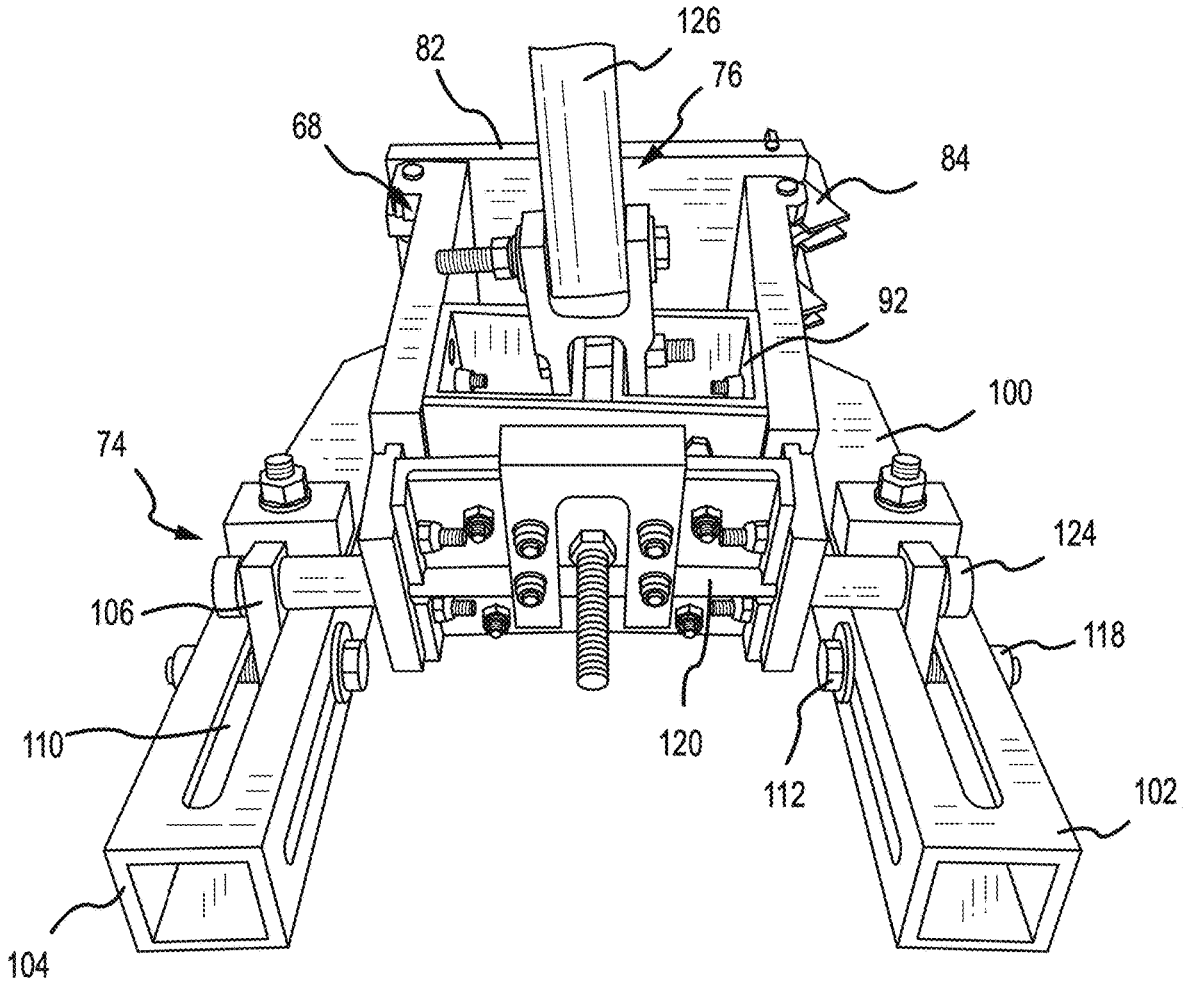
FIG. 13 is a bottom rear second and perspective view of bridge support bracket placement device shown in FIG. 10.
Figure 14:
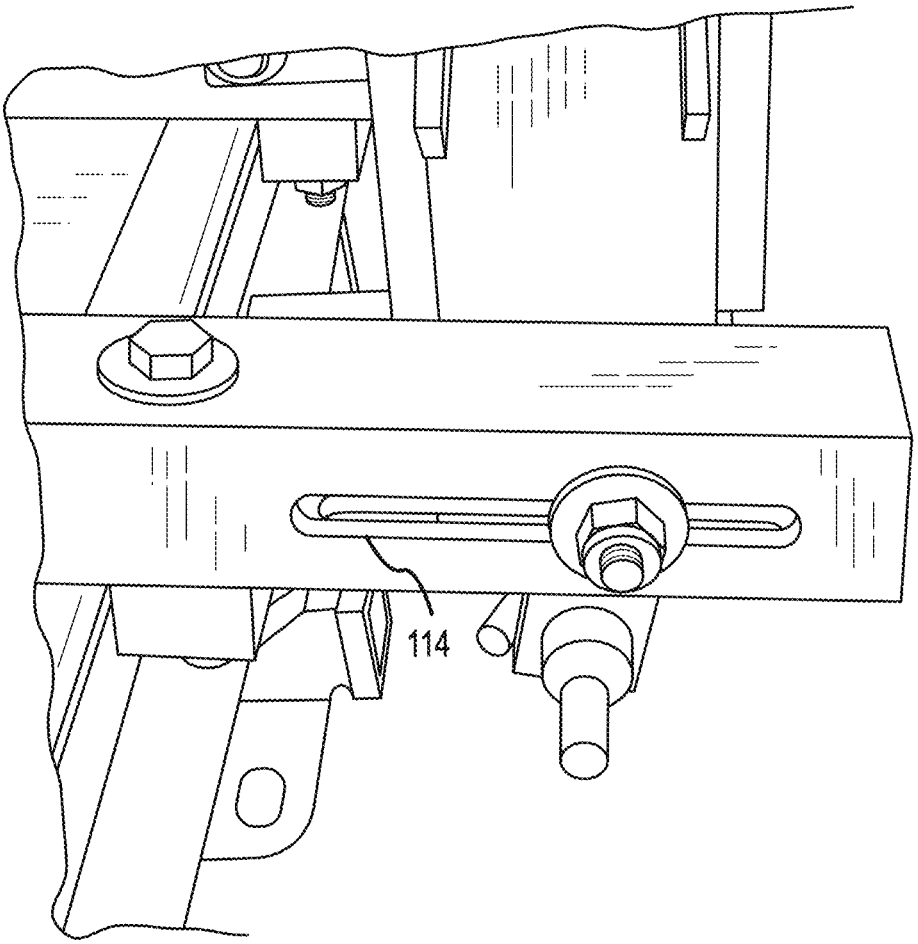
FIG. 14 is a side perspective view of the bridge support bracket placement device.

In the illustrated embodiment, as shown especially in FIG. 13, the clamp 68 is in the form of rectangle box, with one side 82 pivotable between a bracket receiving open position, as shown in FIG. 4, and a bracket securing position, as shown in FIG. 6. An over center hook shaped lock 84 on the side of the clamp 68 is used to releasable secure the one side 82 of the clamp 68 in the bracket held position.

Figure 17:
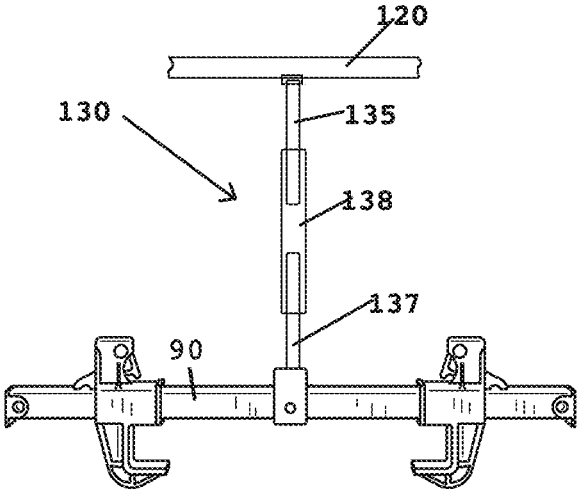
FIG. 17 is a perspective side view of an alternate clamp.

In an alternate embodiment, another holding means to grasp and hold the bracket 30, such as the beam clamp 90 illustrated in FIG. 17, can be used. The beam clamp 90 in FIG. 17 has the advantage of being more readily able to be used with support brackets of different widths. Further, in this alternate embodiment, the pivot means has been simplified by replacing the means for adjusting the height of the clamp with a three-piece extendable rod 130. More particularly, as shown in FIG. 17, the three-piece extendable rod 130 is connected between the clamp and the pivot rod 120. Since the three-piece rod 130 is extendable, the filet height can be adjusted by changing the length of the three-piece rod 130. The three-piece rod 130 is extendable in a fashion similar to a turnbuckle, with two rods 135 and 137 with threaded ends and a central piece 138 with like threads that receive the rods threaded ends. As the threaded end rods turn while the central piece 138 remains stationary, the length of the three-piece extendable rod changes.

Figure 15:
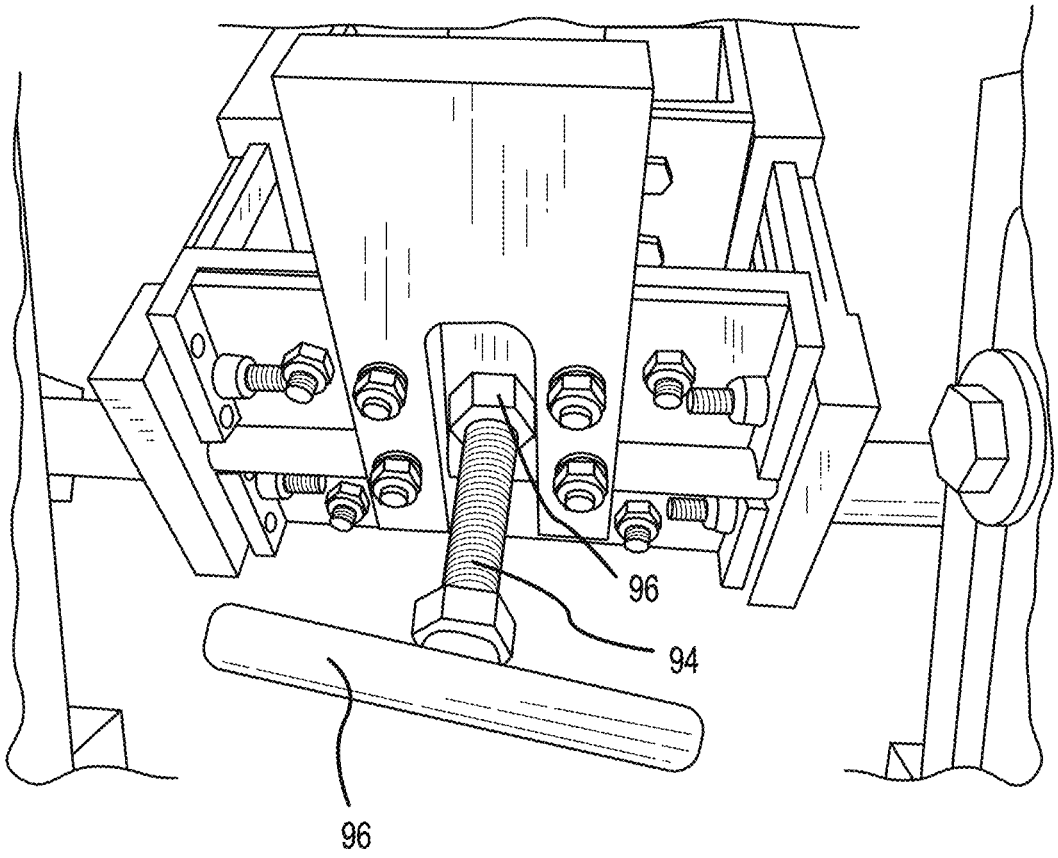
FIG. 15 is an end perspective view of the clamp and its pivot connection to the device support.
Figure 16:
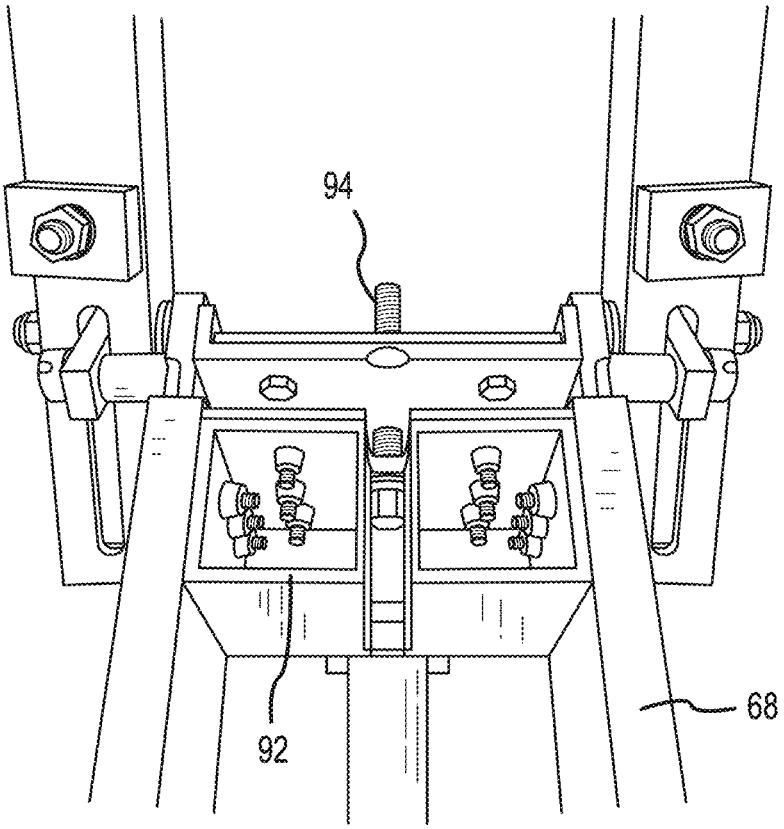
FIG. 16 is in bottom perspective view of the bridge support bracket placement device.

Mounted for relative sliding movement within the clamp rectangle box is a clamp base 92. The clamp base 92 is mounted within the clamp rectangle box and is moveable relative to the bottom of the clamp rectangle by a threaded rod 94 that extends through a threaded hole 96 (see FIG. 15) in the bottom of the rectangle. More particularly, the clamp base 92 is U shaped, with sides that mate using a tongue in grove arrangement with the sides of the rectangular box so the clamp base can slide relative to the sides of the rectangular box. One end of the threaded rod 94 is held at the clamp base 92 and is free to rotate. As the threaded rod 94 turns, the position of the clamp base 92 relative to the bottom of the rectangle changes. In this fashion, the position of the support bracket 30 relative to the support frame 64 and relative to the top of the I-beam 10 can be adjusted. As shown in FIG. 15, a rod handle 96 is attached to the threaded rod 94 to aid in the turning of the threaded rod 94.

In the illustrated embodiment, as shown in FIGS. 10 and 13, the pivot means 70 is in the form of a pivot connection between the clamp 68 and the support frame 64. More particularly, the support frame 64 has a U shape, with a base portion 100 and two arm portions 102 and 104. In each arm portion, there is positioned for sliding movement a clamp hanger 106 in the form of a flat rectangular piece. The clamp hanger 106 is received in a bottom slot 110 and is secured in the bottom slot 110 by a clamp hanger bolt 112 that extends through a side slot 114 (see FIG. 14) in the arm portion. The clamp hanger bolt 112 is secured in place by a clamp hanger bolt nut 118 which can be loosened or tightened as desired. When loose, the clamp hanger 106 can be slide along the support frame arm portion so as to adjust the position of the clamp 68 relative to the support frame base portion 100, and relative to the edge of the I-beam 10. Extending between the clamp hangers 106 is a clamp pivot axle 120. Each clamp pivot axle end extends through a respective clamp hanger through hole (not shown). The ends of the clamp pivot axle 120 are secured in place by a by a clamp pivot axle bolt nut 124.

In the illustrated embodiment, the spacing means 74 for varying the spacing of the clamp 68 relative to the support frame 64 in both a horizontal direction and a vertical direction is in the form of the movable clamp hanger 106, and the movable clamp base 92.

Figure 8:
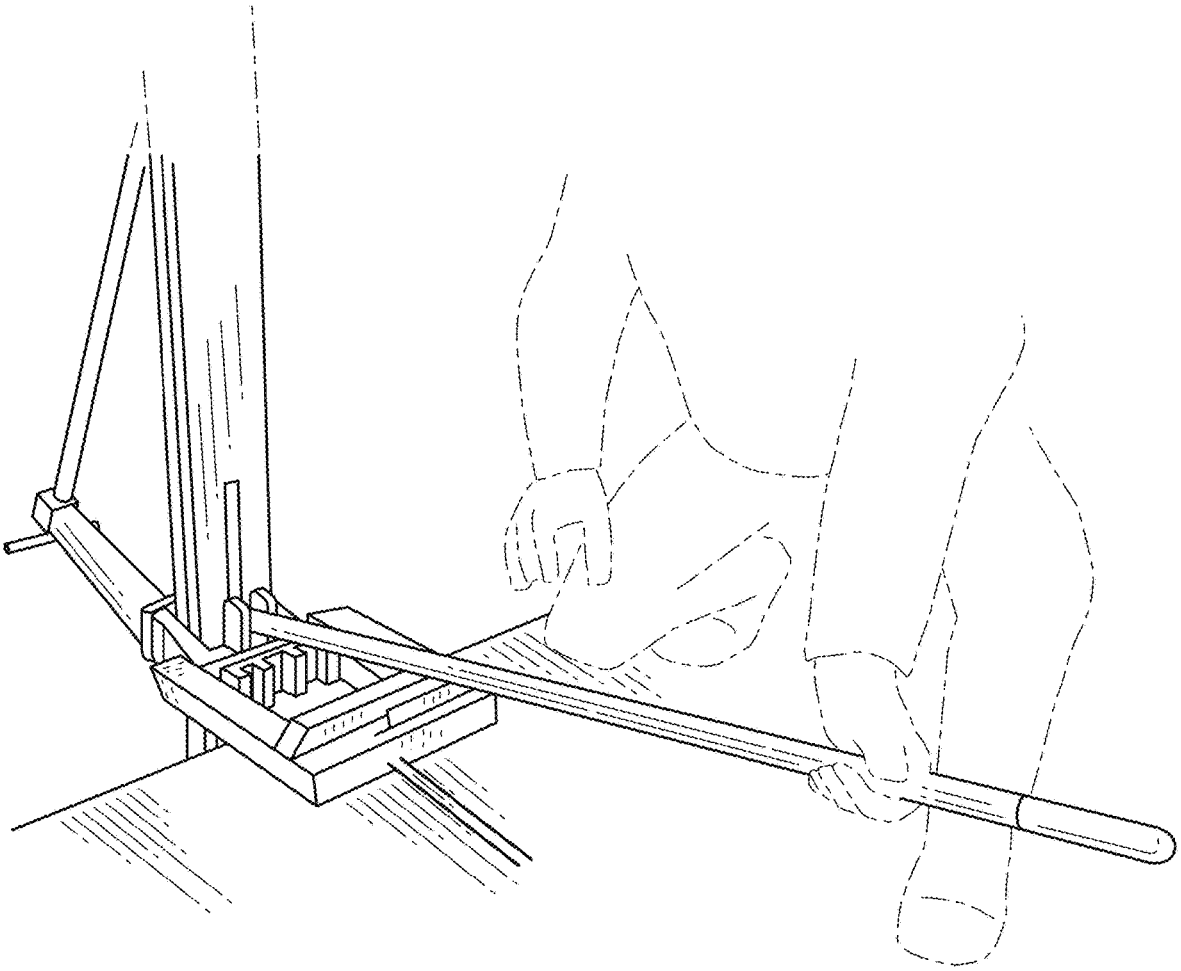
FIG. 8 is a rear perspective view similar to FIG. 4, only now with the clamp having pivoted about 90 degrees to place the support bracket in its final position.
Figure 9:
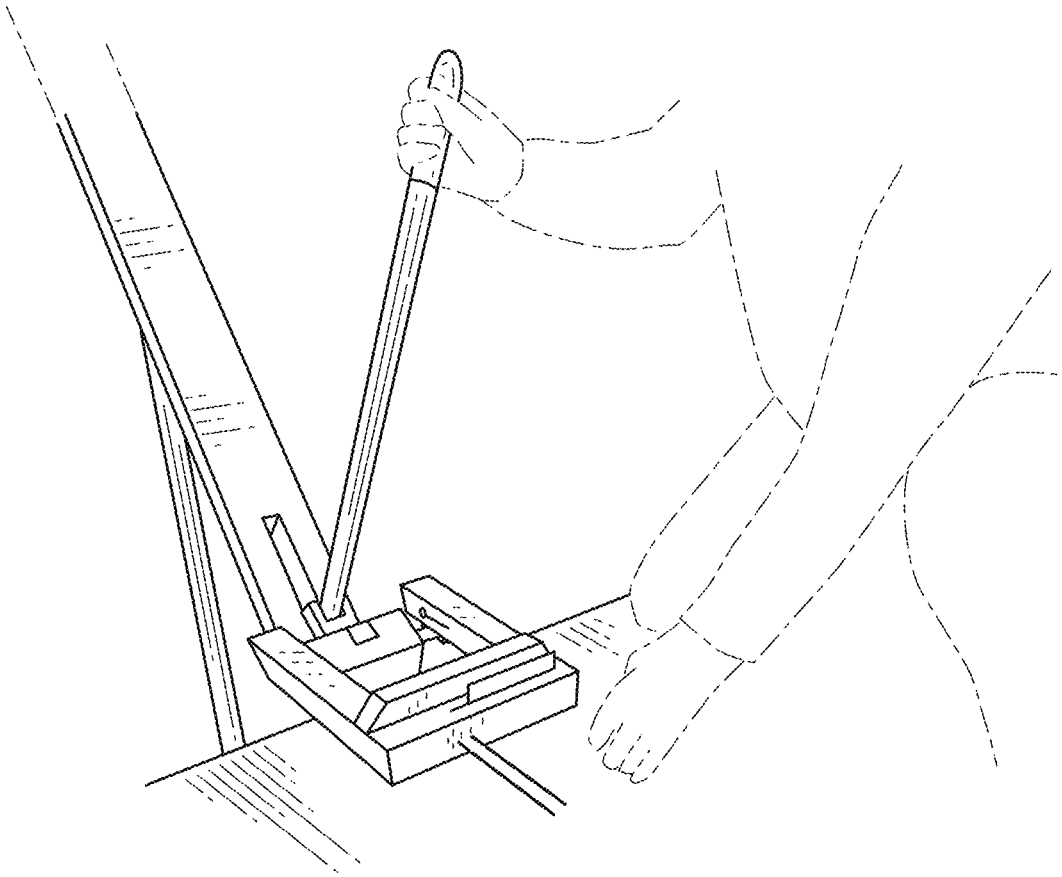
FIG. 9 is a rear perspective view similar to FIG. 4, only now with the clamp nearly finished pivoted to place the support bracket in its final position. A lever arm attached the clamp helps slow and control the pivoting of the clamp.
Figure 10:
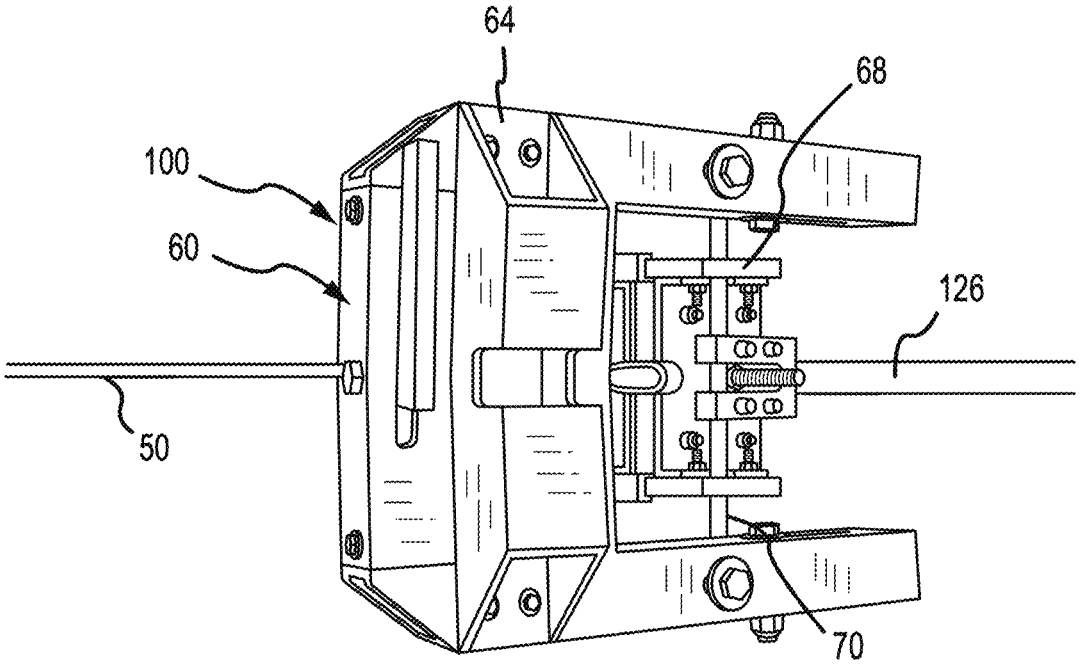
FIG. 10 is a rear perspective view of the bridge support bracket placement device according to this disclosure.
Figure 11:
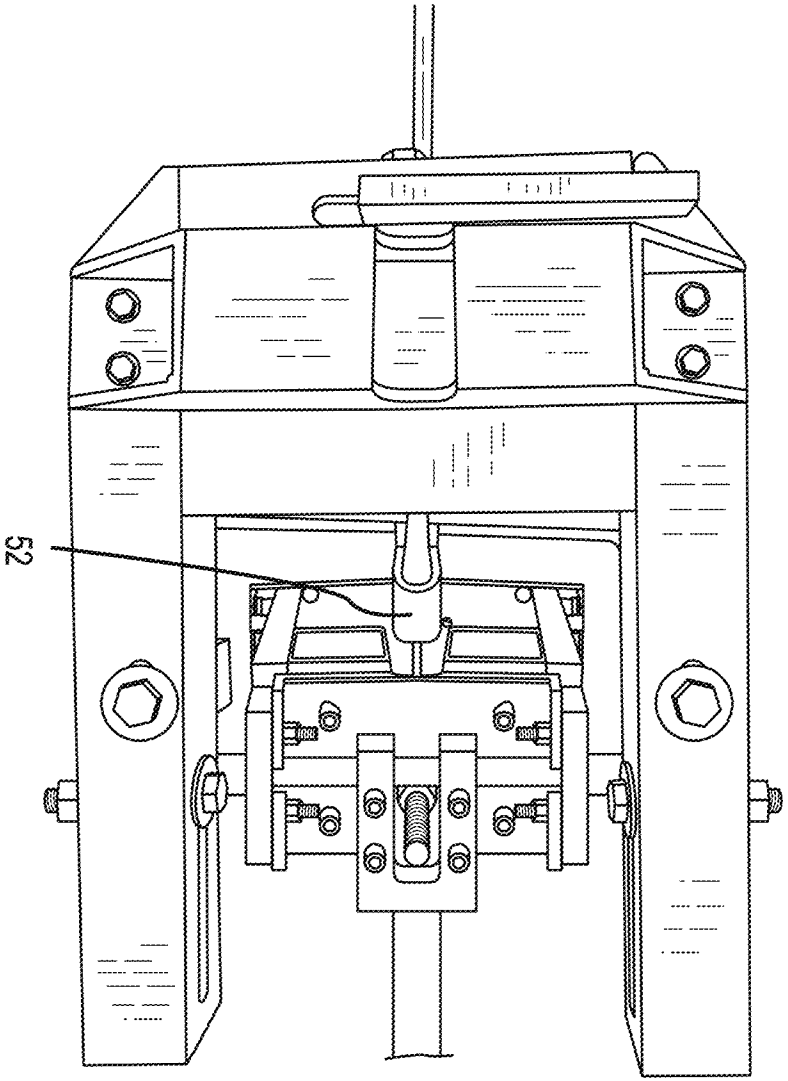
FIG. 11 is a top view of the bridge support bracket placement device shown in FIG. 10.

In the illustrated embodiment, as shown in FIGS. 8, 9 and 13, the controlling means 76 for controlling the pivoting of the clamp 68 relative to the support frame 64 is in the form of a handle 126 pivotally attached to the clamp base 92. When a user holds on to the handle 126, as shown in FIGS. 8 and 9, the rotation of the support bracket 30 relative to the I-beam 10 can be slowed and done in a controlled manner. In other embodiments (not shown), other means for slowing and controlling the rotation of the support bracket 30 relative to the I-beam 10 can be used. For example, a friction disk between the clamp pivot axle bolt nut 112 and the clamp hanger 106 can be used to slow the rotation of the clamp pivot axle 120 relative to the clamp hanger 106 and would provide a slow controlled rotation of the support bracket BO relative to the I-beam 10.

In operation, as illustrated in FIGS. 4-9, a construction worker would begin using the support bracket placement device 60 by securing the support frame 64 to the I-beam 10. In the illustrated embodiment, the hanger 50 is already available and is attached to the I-beam 10.

The hanger clip 52 is at the outside edge of the I-beam 10. The support frame 64 is then secured to the hanger 50 by the hook 66 being rotated in the rear of the device support 64 to the first position where the hanger slot 78 is open to receive the hanger 50. The hook 66 is then rotated to the second position where the hook 66 holds the hanger 50 in the hanger slot 78. The support frame 64 is positioned on the hanger 50 so that the hanger clip 52 is inside the support frame 64 adjacent the support frame base portion 100, as shown in FIG. 10.

The worker then continues by using the clamp 68 pivotally connected to the support frame 64 to grasp and hold the bridge overhang support bracket 30. The support bracket 30 is positioned in the clamp 68 so that the bracket bolt holder 56 is on the worker side of the clamp 68 so that once rotated, the bracket bolt holder 56 will be adjacent the I-beam 10 and by the hanger clip 52. The worker then continues by pivoting the clamp 68 and support bracket 30, as shown in FIGS. 6 to 9, through 180 degrees relative to the support frame 64 and the I-beam 10. While pivoting the clamp 68, the support bracket 30 should not slide relative to the clamp 68. This can be accomplished by having a portion (not shown) of the support bracket 30 abut a portion of the clamp 68, by having the clamp 68 tightly hold the support bracket 30, or by having something (not shown) in the clamp that engages an opening (not shown) in the support bracket. Once the support bracket 30 is placed on the side of the I-beam 10, or even before rotation of the support bracket 30, the end position after rotation of the support bracket 30 can be adjusted both horizontally or vertically so that the hole in the bracket bolt holder 56 is aligned with the hole in the hanger end clip 52. The construction worker can then pass the coil rod 54 through the bracket bolt holder 56 and through the hanger end clip 52, as shown in FIG. 3, and then secure the coil nuts 58 to the ends of the coil rod 54.

Trials with device 60 have shown that one worker can perform in half the time the work formerly done by two, with greater safety and without needing to stop traffic under the bridge under construction, or to provide water craft to support the mechanism used to raise the support bracket to bridge level. The foregoing is considered as illustrative only of the principles of the invention. Furthermore, since numerous modifications and changes will readily occur to those skilled in the art, it is not desired to limit the invention to the exact construction and operation shown and described.

Method for Creating a Wood Platform on Top of Support Brackets

As shown in FIG. 1, the support brackets 30 are intended to support concrete forms 22. Part of the process of creating the concrete forms 22 involves the attachment of forming wood studs to bracket wood boards on the top of the support brackets 30. More particularly, after the support brackets 30 are positioned in place, as shown in FIG. 1, the next step is to attach pieces of forming wood studs to the bracket boards on top of the support brackets 30. The wood on top of the support brackets 30 is used as a work surface or as a concrete form 22. Conventionally, to put the forming wood studs on top of the support brackets 30, a workman has to crawl out onto the spaced apart support brackets 30 in order to position a form wood stud in place so that the forming wood stud spans two support brackets. The workman then nails or screws the forming wood stud to the wood boards on top of the spaced apart support brackets 30. As can be readily recognized, this is a precarious and potentially dangerous thing to do.

This disclosure is directed to a system of attaching forming wood studs to the bracket wood boards on top of the support brackets without the need for a workman to have to crawl out onto the support brackets.

Figure 18:
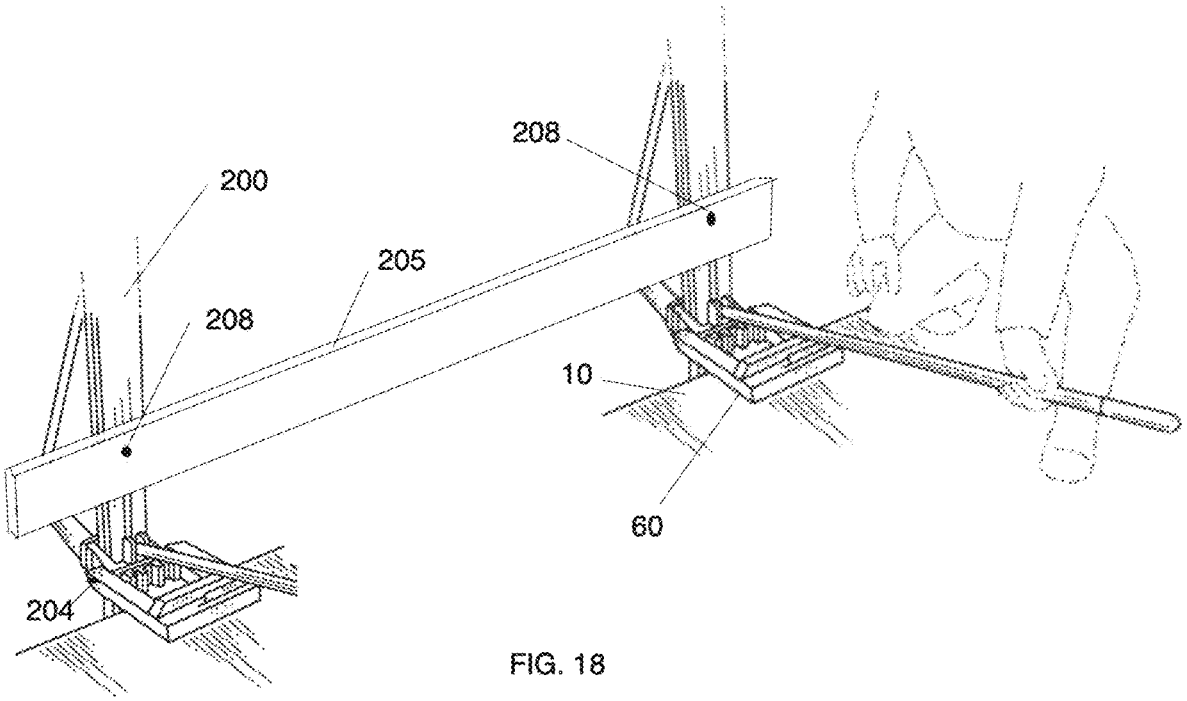
FIG. 18 is a rear perspective view of two spaced apart bridge support bracket placement devices as shown in FIG. 8, with a forming wood stud attached to wood boards attached to the tops of the support brackets.

When the bridge support bracket 30 is in the device 60 and in the position shown in FIG. 8, the bracket 30 includes a bracket wood board 200 (see FIG. 18) that faces the individual operating the device 60. As shown in FIG. 18, a locking pin 204 is attached to and supported by the base portion 100 of the device 60 aligns with an aperture (not shown) in the clamp 68 so that the locking pin 204 can be used to lock and hold the clamp 68 in the position shown in FIG. 8, where the bracket wood stud 200 is in a vertical position. If two devices 60 are spaced apart and held on the I-beam 10, then a workman can hold a form wood stud 205 at where it spans the two spaced apart bracket wood boards 200. While in this position, the workman can attach the form wood stud to each of the bracket wood boards 200 such as by screws or nails 208. By attaching the form wood stud 205 to the bracket wood boards 200 at a location where the workman can stay safely on top of the I-beam 10, this avoids the workman having to leave the safety of the I-beam 10 and to crawl out on to the support brackets 30 to attach the forming wood studs 205 to the support brackets 30. Additional pieces of wood (not shown) can also be attached to the wood structure described thus far while the bracket wood studs 200 are still in the vertical position shown, if so desired. In other embodiments (not shown), structure can support the support bracket wood boards in a partially pivoted not horizontal position where a workman can then attach (such as with screws) the wood boards 200 to the forming wood stud 205 held in a position where it spans the support brackets 30.

While the preferred embodiment has been described, the details may be changed without departing from the invention, which is defined by the claims. Various other features and advantages of the invention will be apparent from the following claims.

The invention claimed is:

1. A method for creating a wood platform on top of support brackets adapted to be attached to the side of a beam, each support bracket including a wood board attached to the support bracket and adapted to be attached to wood studs, the method comprising the steps of:

providing at least two devices for assisting to secure the support brackets to the beam, each device comprising: a support frame, securing means to secure the support frame to the beam, holding means to grasp and hold the bracket, and pivot means pivotally connecting the holding means to the support frame, attaching the least two spaced apart devices to the beam, clamping a support bracket in each of the at least two spaced apart devices, pivoting both support brackets to a position where the support bracket wood boards are held in a not horizontal position, and then placing a wood stud in a position where it spans the two support brackets, and then attaching together the wood stud and the respective bracket wood boards, and then further pivoting the support brackets to where the wood boards extend horizontally away from the beam.

* * * * *